US012480305B2

(12) United States Patent
Kemi et al.

(10) Patent No.: US 12,480,305 B2
(45) Date of Patent: Nov. 25, 2025

(54) FAÇADE INSULATING SYSTEM

(71) Applicant: Glava AS, Askim (NO)

(72) Inventors: Christer Kemi, Sarpsborg (NO); Ole-Jacob Huuse, Askim (NO)

(73) Assignee: SAINT-GOBAIN ISOVER, Courbevoie (FR)

( * ) Notice: Subject to any disclaimer, the term of this patent is extended or adjusted under 35 U.S.C. 154(b) by 261 days.

(21) Appl. No.: 18/189,763

(22) Filed: Mar. 24, 2023

(65) Prior Publication Data

US 2023/0304281 A1 Sep. 28, 2023

(30) Foreign Application Priority Data

Mar. 25, 2022 (NO) ..... 20220362

(51) Int. Cl.
*E04B 1/80* (2006.01)
*E04B 1/38* (2006.01)

(52) U.S. Cl.
CPC ..... *E04B 1/80* (2013.01); *E04B 1/388* (2023.08); *E04B 2001/389* (2023.08)

(58) Field of Classification Search
CPC .... E04B 1/7069; E04B 1/7076; E04B 1/7038; E04B 1/80; E04B 1/388; E04B 1/389;
(Continued)

(56) References Cited

U.S. PATENT DOCUMENTS 2,034,489 A * 3/1936 Scherer ..... E04C 2/3405 52/783.17
2,039,601 A * 5/1936 London ..... E04B 1/74 52/783.17

(Continued)

FOREIGN PATENT DOCUMENTS

CN 2330731 Y 7/1999
DE 202005020190 U1 7/2006

(Continued)

OTHER PUBLICATIONS

Norwegian Search Report issued in No. 20220362 mailed on Oct. 5, 2022 (3 pages).

(Continued)

*Primary Examiner* — James A Shriver, II
(74) *Attorney, Agent, or Firm* — Osha Bergman Watanabe & Burton LLP

(57) ABSTRACT

A façade insulating system includes an insulation panel of thermal insulation material, an outer panel, and a plurality of fastening devices. The thermal insulation material includes a first surface configured to face a wall of a building, a second surface opposite the first surface, and side surfaces. The plurality of fastening devices are configured to connect the outer panel and the insulation panel to the wall of the building. The insulation panel includes protrusions distributed over the second surface of the insulation panel. The protrusions are configured to abut the outer panel, such that, when the outer panel and the insulation panel are connected to the wall of the building, air channels are formed between the second surface of the insulation panel and the outer panel. Each of the plurality of fastening devices includes a distancing section. The distancing section includes two bracket sections. One of the bracket sections defines a first contact surface for abutment against the second surface of the insulation panel. The other bracket section defines a second contact surface for abutment against an inner surface of the outer panel, thereby determining a distance equal to a height of the protrusions between the second surface of the insulation panel and the inner surface of the outer panel.

20 Claims, 12 Drawing Sheets

(58) Field of Classification Search
CPC ... E04F 13/007; E04F 13/075; E04F 13/0801; E04F 13/0803; E04F 13/0805; E04F 13/081; E04F 13/0821; E04F 13/0826; E04F 13/0828; E04F 13/083; E04F 13/0841; E04F 13/0846; E04F 13/0875; E04F 13/0878; E04F 13/076; E04F 13/0889
See application file for complete search history.

(56) References Cited

U.S. PATENT DOCUMENTS

| | | | | |
|---|---|---|---|---|
| 4,736,561 | A * | 4/1988 | Lehr | E04D 13/1681 52/410 |
| 4,973,506 | A * | 11/1990 | Bauer | B32B 15/08 428/116 |
| 5,543,204 | A * | 8/1996 | Ray | B32B 7/12 428/184 |
| 6,158,178 | A * | 12/2000 | Jeffers | E04B 2/7437 52/505 |
| 6,260,323 | B1 * | 7/2001 | Hockey | E04B 2/74 52/537 |
| 6,615,560 | B2 * | 9/2003 | Ito | E04F 13/0846 248/220.21 |
| 9,212,485 | B2 * | 12/2015 | Wolynski | C04B 28/04 |
| 9,249,572 | B2 * | 2/2016 | Neumayr | E04C 2/3405 |
| 12,338,626 | B1 * | 6/2025 | Neumayr | E04C 2/322 |
| 2004/0226238 | A1 * | 11/2004 | Haapiainen | E04B 1/14 52/302.1 |
| 2006/0191232 | A1 | 8/2006 | Salazar et al. | |
| 2015/0191912 | A1 * | 7/2015 | Bordener | E04F 13/0826 52/772 |
| 2016/0289976 | A1 | 10/2016 | Suzuki | |
| 2017/0130464 | A1 | 5/2017 | Gleeson et al. | |
| 2017/0254091 | A1 * | 9/2017 | Friel | E04F 19/02 |
| 2018/0258633 | A1 | 9/2018 | Power | |
| 2018/0334809 | A1 * | 11/2018 | Smart | E04F 13/0846 |
| 2019/0017270 | A1 * | 1/2019 | Raab | E04C 2/292 |
| 2019/0345713 | A1 * | 11/2019 | Lolley | E04B 1/80 |
| 2023/0304281 | A1 * | 9/2023 | Kemi | E04B 1/388 |

FOREIGN PATENT DOCUMENTS

| | | | | |
|---|---|---|---|---|
| EP | 0204015 | A1 | 12/1986 | |
| EP | 1052338 | A2 | 11/2000 | |
| EP | 2589725 | A2 | 5/2013 | |
| EP | 2851193 | A1 | 3/2015 | |
| EP | 4249700 | A1 * | 9/2023 | E04F 13/0876 |
| JP | H08-253977 | A | 10/1996 | |
| KR | 10-2014-0025246 | A | 3/2014 | |
| KR | 2250206 | B1 * | 5/2021 | E04B 1/7076 |
| NL | 2025075 | B1 * | 10/2021 | |
| NO | 344327 | B1 | 11/2019 | |
| WO | WO-2004092494 | A2 * | 10/2004 | E04F 13/007 |
| WO | WO-2019035724 | A1 * | 2/2019 | |

OTHER PUBLICATIONS

Extended European Search Report issued in counterpart European Application No. 23164171.3 mailed on Aug. 3, 2023 (8 pages).

* cited by examiner

FAÇADE INSULATING SYSTEM

FIELD THE INVENTION

The present invention relates generally to building materials, and in particular to a façade insulating system comprising an insulation panel of thermal insulation material and an outer panel, wherein air channels are formed between the insulation panel and the outer panel when the outer panel and the insulation panel are connected to the wall of the building.

BACKGROUND OF THE INVENTION

Façade insulating systems can be attached to an outer surface of a building and can be arranged with different materials like synthetic materials, wooden panels, marble, bricks etc. providing different patterns and/or different architectural expressions.

Façade insulating systems can be attached onto concrete walls, masonry, or onto building frameworks constituted by timber or aluminum etc., or girders or beams, concrete, or steel beams etc., or a combination of these types of building frameworks.

When closing the interior space of a house with walls it is important to take note of several different physical phenomena and properties of buildings. A major issue is insulation as well as diffusion of moisture (or water) from the exterior of a house through respective outer walls as well as from the interior of the house towards the exterior of the house. Therefore, transport of heat and moisture through building walls is a technical design challenge. If the insulation properties of building walls are poor, the cost of heating or cooling a house can be extremely high. It is also important to take into account the increasing need of reducing the overall energy consumption in society. If moisture is left inside building walls, several biological process may start, for example development of dry rot and/or fungus. This may affect residents of houses as well as reducing the lifetime of the house.

There are also other aspects of building houses that influence both the use and design of the façade insulation system. Reducing the building time of a house makes houses considerably cheaper, which may benefit house buyers as well as housing developers. The aesthetic aspect is also important.

Façade insulating systems are not only used when constructing new houses, they may also be used when modernizing or repairing older houses.

WO2019035724 A1 discloses a cladding panel that can be mounted onto an existing building wall, or onto a building framework. The cladding panel is especially suited to be used when modernizing older wooden houses. The cladding panel comprises at least an insulation layer, an airing layer and an exterior panel that may be decorated providing a unique architectural impression of a house. The cladding panel comprises horizontal and vertical airing channels prefabricated inside the respective cladding panels.

EP2851193A1 discloses a pre-fabricated construction panel for use on an external surface and/or as part of a building or construction. The panel comprises at least a first layer which is at least partially provided from thermally insulating material having a first surface, the panel comprising at least a second layer, the at least second layer being provided from fiber cement board, the second layer having a second surface facing the first surface. The first surface is profiled having recessed surface zones and heightened surface zones, the first and the second layers being connected one to the other at least along the heightened surface zones of the first, the recessed surface zones provides at least one interspace between the first and second surface. This at least one interspace has at least two openings to the external of the panel for enabling air to flow into and out of the interspace towards the external of the panel.

EP0204015A1 discloses a construction module for the production of a thermally insulated curtain façade comprising thermal insulation panels with columnar spacers which are distributed over an entire side of a panel and which are spaced from each other and which are arranged on diagonal, mutually parallelly extending rows and which are of substantially the same height and which are in one piece with the thermal insulation panel, and cover surfaces. The spacers are so arranged on the thermal insulation panels and are at such spacings and of such dimensions that disposed between them are unobstructed, continuous, straight passages which are arranged both diagonally between two mutually oppositely disposed panel edges and also perpendicularly to said two mutually oppositely disposed panel edges, wherein the spacing between two adjacent spacers which are disposed on a line parallel to the two respective parallel panel edges is greater than the largest diameter of the spacers in the same direction, thus also providing unobstructed vertical air passages. The spacers may be of a square cross-section.

The problem of moisture inside building walls is usually dealt with by arranging membranes stopping moisture from migrating through for example insulation materials in the wall. However, there may be a huge temperature difference between the exterior of a house and the interior of a house. Therefore, moisture inside walls is also related to condensation of humidity. This may result in forming droplets residing inside the wall. Therefore, airing of the interior space of walls is necessary, not just to transport out humidity in the form of vapor for example, but also to be able to dry out constructional elements inside the wall being humidified through for example condensation.

A common solution, for example when constructing a wooden wall, is to arrange a vapor barrier on interior surface walls and arranging vertical channels behind the back side of the outer cladding or panel of the wall. It is common to arrange vertical furring strips supporting an outer cladding of the wall. The physical principle is that at the bottom of the wall close to the ground the temperature is normally lower than the temperature at a top end of the wall close to the roof. The temperature difference works as a "motor" creating a vertical airstream flowing from the bottom of the wall up to the roof end of the wall inside spaces defined by the spaced apart furring strips and the backside of the outer cladding or panels.

However, building walls are usually not a homogenous object. Cutouts are made supporting for example windows and doors. With reference to the use of furring strips above, the vertical airing channels are broken or blocked when for example a window is inserted into an adapted cutout.

NO344327 B1 discloses a cladding panel comprising an insulating mat that is attached to the backside of an airing plate. The airing plate comprises a plurality of accumulation cups that are configured to collect humidity from the insulating mat.

The natural airing constituted by a temperature difference between the bottom end of a vertical wall and a top end of the vertical wall is effective if the temperature difference is above a certain level. The contributing factors of maintaining a temperature difference, and hence an airing "motor", is normally not constant. Therefore, the airing effect the motor may provide can therefore vary during day and night conditions and changing weather conditions for example.

The loss of air flow, or resistance to air flow is dependent on the geometrical design of the air channels or airing layer in the façade insulating system and affects the heat loss and the air channel's ability to transport out moisture.

Thermal bridges are pathways for heat transfer through components of a floor, walls, roof etc. Thermal bridges should be insulated or avoided to prevent heat flow and condensation risk.

Therefore, it is a need of an improved façade insulating system for exterior building walls, providing improved airing of moisture and for example water droplets formed inside walls while maintaining good insulating properties. There is further a need for a façade insulating system with improved and/or easier mounting or fastening to the building walls.

SUMMARY OF THE INVENTION

The present invention is set forth and characterized in the independent claims, while the dependent claims describe other characteristics of the invention.

With the abovementioned challenges in mind, the present disclosure brings forward a façade insulating system providing protrusions between a surface of a thermal insulation panel and an outer panel of the façade insulating system, such that air channels are formed between insulation panel and the outer panel when connected together to the building wall. Furthermore, fastening devices are used to connect the outer panels and the insulation panels to the building wall.

Accordingly, the present disclosure relates to a façade insulating system comprising:

- an insulation panel of thermal insulation material comprising a first surface configured to face a wall of a building, a second surface opposite the first surface, and side surfaces;
- an outer panel;
- a plurality of fastening devices configured to connect the outer panel and the insulation panel to the wall of the building;
- wherein the insulation panel comprises protrusions distributed over the second surface of the insulation panel, the protrusions being configured to abut the outer panel, such that, when the outer panel and the insulation panel are connected to the wall of the building, air channels are formed between the second surface of the insulation panel and the outer panel.

The façade insulating system of the disclosure may be installed on a new building, or on an existing building, for example where a change of the façade or cladding may be required. In the latter scenario, the existing cladding may be removed and the façade insulating system of the disclosure may be installed in a similar manner as for a new building. However, the façade insulating system may also be installed on top of the existing cladding. In such case, it is important to ensure that a proper vapor barrier and air barrier (or wind barrier) is established prior to mounting the façade insulating system. It may for example be necessary to seal the previous airing layer of the old cladding.

In one aspect, each of the plurality of fastening devices comprises a distancing section. The distancing section determines a distance between an inner surface of the outer panel (the surface of the outer panel which is facing the insulation panel), and the second surface of the insulation panel (from where the protrusions protrude).

In one aspect, the distancing section provides a distance which is equal to a height of the protrusions. Thus, the protrusions will abut against the outer panel.

In one aspect, the distancing section comprises two bracket sections, wherein one of the bracket sections defines a first contact surface for abutment against the second surface of the insulation panel, and wherein the other bracket section defines a second contact surface for abutment against the inner surface of the outer panel.

In one aspect, the distance between the first contact surface and the second contact surface is equal to the height of the protrusions. Thus, the protrusions will abut against the outer panel.

Consequently, in the façade insulating system each of the plurality of fastening devices may comprise a distancing section, wherein the distancing section may comprise two bracket sections, wherein one of the bracket sections may define a first contact surface for abutment against the second surface of the insulation panel, and wherein the other bracket section may define a second contact surface for abutment against an inner surface of the outer panel, thereby determining a distance equal to a height of the protrusions between the second surface of the insulation panel and the inner surface of the outer panel.

In one aspect, the protrusions are distributed such that at least one air channel extends between two opposite side surfaces of the insulation panel. Air can then flow from one end of the panel to the opposite end of the panel and further via the next panel and so on through the façade wall.

In one aspect, the protrusions are solid protrusions made of thermal insulation material. The protrusions thus contribute to thermal insulation in addition to forming the air channels.

In one aspect, the protrusions have a cylindrical shape or the shape of a truncated cone. With a rounded shape of the protrusions, sharp corners or 90° edges can be avoided. Even more so in the case of a truncated cone, where also the edge formed between the bottom of the protrusion and the second surface of the insulation panel will not form a sharp, 90° edge. The rounded shape reduces tension peaks under mechanical load. In aspects, the upper surface of the protrusions may be chamfered.

In one aspect, the protrusions are evenly distributed over the second surface of the insulation panel. The protrusions may be aligned in rows in two perpendicular directions, e.g. horizontally and vertically, such that the air channels between the rows of protrusions follows a straight path between two opposite side surfaces of the insulation panel. The protrusions may be distributed such that the air channels extend vertically (i.e. up/down) and horizontally (i.e. sideways) across the insulation panel. Air flow up/down and sideways across the façade can thus be obtained.

In one aspect, the height of the protrusions is between 15-25 mm, preferably 20 mm. This height of protrusions provides air channels with a sufficient air flow to avoid moisture build-up and/or sufficient insulation.

In one aspect, the protrusions have the shape of a truncated cone, wherein each protrusion has a larger diameter closer to the second surface of the insulation panel than at the top surface of the protrusion, which abuts the outer panel. The air channels formed between the protrusions is thus wider in the area closer to the outer panel than in the area closer to the second surface of the insulation panel.

In one aspect, the protrusions take up more than 25% of the volume between the second surface of the insulation panel and the outer panel, preferably more than 40% or more preferably at least 45% of the volume. In one aspect, the protrusions take up between 41%-70% of the volume between the second surface of the insulation panel and the outer panel, more preferably 41%-60% of the volume, or even more preferably 45-55% of the volume, the remaining volume being air channels.

In one aspect, the smallest gap between two adjacent protrusions is at least 15 mm, preferably at least 20 mm to ensure sufficient air flow through the air channels. In one aspect, the gap between two adjacent protrusions in a row is smaller than the width or diameter (i.e. lateral extension) of the protrusions. The size of the gap determines the size of the air channels.

If the protrusions are shaped as a truncated cone, the smallest gap between two adjacent protrusions in a row, in the area close to the second surface of the insulation panel, preferably has a width of at least 20 mm.

In one aspect, the protrusions are formed integral with the insulation panel, i.e. the insulation panel with the protrusion may be made from one piece of raw material. The protrusions may for example be formed by milling or by molding the panel, depending on the insulation material used.

In one aspect, the insulation panel is made of mineral wool, such as glass wool, stone wool or slag wool, or polystyrene (foam board, typically MEPS), PUR (polyurethane), PIR (polyisocyanurate).

In one aspect, the insulation panel is a pressure-resistant insulation panel which is self-supporting. By pressure-resistant, it is meant that the insulation panel will not be compressed when mounted as part of a façade insulating system on a wall of the building, i.e. it will retain its shape.

In one aspect, the side surfaces of the insulation panel are configured for connecting to a side surface of an adjacent insulation panel through a tongue and groove joint.

In one aspect, at least one side surface of the insulation panel is provided with a tongue profile comprising a chamfered edge (i.e. a section of the tongue profile is inclined), and at least one side surface is provided with a groove profile complementary to the tongue profile for connecting adjacent insulation panels through the tongue and groove joint.

In one aspect, the insulation panel is rectangular or square shaped.

In one aspect, two opposite side surfaces of a corner of a rectangular or square shaped insulation panel comprises a tongue profile and the two other side surfaces comprises a groove profile. Thus, the insulation panel can be rotated 90°, i.e. be turned from lying to standing, while still being connectable to the adjacent insulation panels by the tongue and groove joint.

Various combinations of lying and standing insulation panels can be envisaged. In one aspect, one lying rectangular insulation panel (the short sides represent the vertical height of the insulation panel), can be adjoined with two or more standing rectangular insulation panels (the long sides represent the vertical height of the insulation panel).

In one aspect, each fastening device comprises a fastening element, which may for example be a screw hole, for fastening the fastening device to the insulation panel and the wall of the building.

In one aspect, each fastening device comprises a profile part complementary shaped relative to the chamfered edge, and wherein a fastening element is provided on the profile part.

In one aspect, the fastening device is configured to extend from the outer panel and to finish short relative to the first surface of the insulation panel, such that it does not come into contact with the wall of the building. Heat flow is thus not transferred to the building via the fastening device.

In one aspect, each fastening device comprises a distancing section equal to a height of the protrusions. The distancing section determines the distance between the inner surface of the outer panel (the surface of the outer panel which is facing the insulation panel), and the second surface of the insulation panel (from where the protrusions protrude). Thus, the protrusions will abut against the outer panel.

In one aspect, the fastening device comprises a bracket piece, and two opposing side edges of two neighboring outer panels each comprises a recess, and wherein the bracket piece is configured for engaging with the respective recesses. This allows for the fastening device to connect the outer panels to the wall of the building, and also allows for a smooth façade surface as the fastening devices are not extending outside the outer panels and can be invisible when seeing the façade from the outside.

In one aspect, the fastening device is made of metal, such as aluminum, aluminum alloys, or steel, composite material, or reinforced plastic. Other materials having the required structural properties may be used, and considerations regarding transfer of heat and fire resistance should also be considered.

In one aspect, the fastening element of the fastening device is a through hole for insertion of a fastener (e.g. a screw or a nail) through the hole, the insulation panel and further into a part of the wall of the building.

In one aspect, the inner surface of the outer panel comprises a slot and the fastening device comprises a rim, wherein the rim is configured to engage with the slot. This provides support and mechanical stability to the façade insulating system and will ensure correct positioning of the outer panel during assembly and contribute to make assembly easier.

In one aspect, the outer panel is attached to the insulation panel by an adhesive. The adhesive may be applied prior to transport such that the insulation panel and outer panel will be handled and transported as one unit, thereby reducing risk of damage to the outer panel as the insulation panel will provide support. The adhesive may also be applied before mounting the façade insulation panel in order to facilitate the assembly and mounting process as handling and positioning will be easier.

In one aspect, the façade insulating system comprises a base profile for connecting to a side surface of one or more adjacent insulation panels and for connecting to an edge of one or more adjacent outer panels, the base profile comprising a base profile bracket piece configured for engaging with a recess in the edge of the one or more outer panels.

In one aspect, the base profile comprises a first section for receiving the side surface of the one or more insulation panels, and a second section arranged between the first section and the base profile bracket piece, wherein the first section comprises thermal break slots and/or wherein the second section comprises vent gaps.

In one aspect, the base profile is made of metal, such as aluminum, aluminum alloys, or steel, composite material, or reinforced plastic. Other materials having the required structural properties may be used, and considerations regarding transfer of heat and fire resistance should also be considered.

The thermal break slots of the base profile break the thermal bridge across the base profile, i.e. the flow of heat is reduced. The thermal break slots are preferably arranged as longitudinal slots along the first section of the base profile. Preferably, several rows of longitudinal thermal break slots are arranged next to each other, and where the slots of one row are longitudinally displaced relative to the neighboring row of slots. The heat flow path across the base profile is thus obstructed by the thermal break slots.

The vent gaps are configured to allow air to flow in through the gaps. The vent gaps are preferably arranged transversally across the second section of the base profile.

In one aspect, the façade insulating system comprises a number of insulation panels and outer panels arranged in rows, one row arranged above the other, the insulation panels being connected end-to-end vertically and horizontally through the tongue and groove joint, and the outer panels being connected to the insulation panels by the fastening devices.

The insulation panels and outer panels may be aligned vertically and horizontally. In one aspect, one row of insulation panels and outer panels may be displaced sideways to obtain a brick pattern. As previously mentioned, various combinations of lying and standing insulation panels can be envisaged.

In one aspect, the façade insulating system comprises one or more base profiles connected to a lower most row of insulation panels and outer panels.

The present disclosure also relates to an insulation panel for a façade insulating system of a building, the insulation panel being made of a thermal insulation material and wherein the insulation panel comprises:

- a first surface configured to face a wall of the building,
- a second surface opposite the first surface, the second surface being configured to face an outer panel,
- protrusions distributed over the second surface, the protrusions having a cylindrical shape or the shape of a truncated cone and being a solid body of thermal insulation material, wherein the protrusions are configured to abut the outer panel, such that air channels are formed between the second surface of the insulation panel and the outer panel when the protrusions abut against the outer panel.

In one aspect, the insulation panel is configured to be connected to the well of the building through a plurality of fastening devices.

In one aspect, each of the plurality of fastening devices comprises a distancing section. The distancing section determines a distance between an inner surface of the outer panel (the surface of the outer panel which is facing the insulation panel), and the second surface of the insulation panel (from where the protrusions protrude).

In one aspect, the distancing section provides a distance which is equal to a height of the protrusions. Thus, the protrusions will abut against the outer panel.

In one aspect, the distancing section comprises two bracket sections, wherein one of the bracket sections defines a first contact surface for abutment against the second surface of the insulation panel, and wherein the other bracket section defines a second contact surface for abutment against the inner surface of the outer panel.

In one aspect, the distance between the first contact surface and the second contact surface is equal to the height of the protrusions. Thus, the protrusions will abut against the outer panel.

Consequently, the insulation panel may be configured to be connected to the wall of the building through a plurality of fastening devices, wherein each of the plurality of fastening devices may comprise a distancing section, wherein the distancing section may comprise two bracket sections, wherein one of the bracket sections may define a first contact surface for abutment against the second surface of the insulation panel, and wherein the other bracket section may define a second contact surface for abutment against an inner surface of the outer panel, thereby determining a distance equal to a height of the protrusions between the second surface of the insulation panel and the inner surface of the outer panel.

DETAILED DESCRIPTION OF THE INVENTION

Having generally described this invention, a further understanding can be obtained by reference to certain specific embodiments, which are provided herein for purposes of illustration only, and are not intended to be limiting unless otherwise specified.

Throughout this document, the terms "vertical" and "horizontal" are not to be interpreted strictly. For example, the use of "vertical" and "horizontal" in the expression "vertical air channel" and "horizontal air channel" is intended to mean that air channels are formed in two directions perpendicular to each other, and for rectangular or square shaped panels, this will usually be sideways and upwards/downwards across the panel as installed on the building. If the insulation panel is a rectangular panel placed lying (i.e. with the short sides representing the height of the panel) then the horizontal air channels extend sideways from one short side to the opposite short side. If the same insulation panel is placed standing (i.e. with the long sides representing the height of the panel), then it is the air channels extending sideways from one long side to the opposite long side which are the horizontal air channels.

Figure 1:
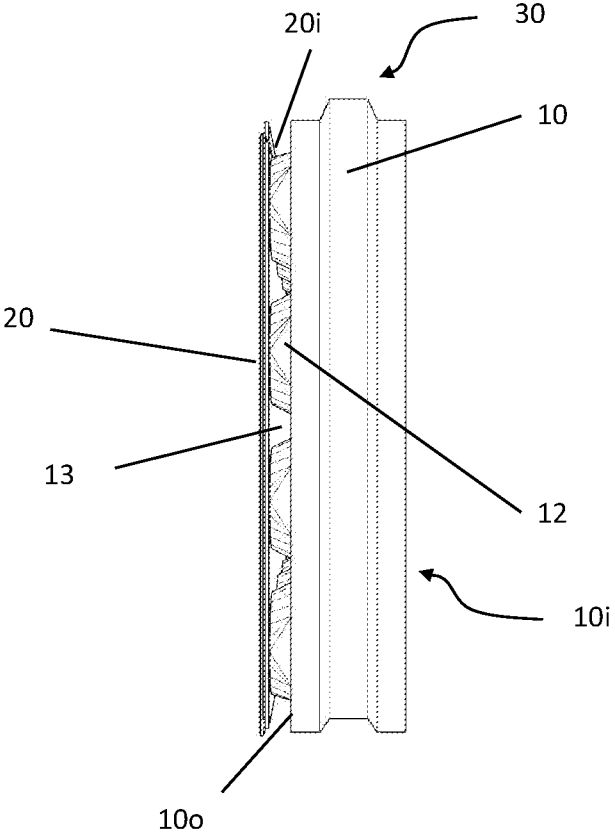
FIG. 1 is a side view of an insulation panel and an outer panel according to an embodiment of the disclosure.

FIG. 1 is a side view of an insulation panel 10 and an outer panel 20 according to an embodiment of the disclosure. The insulation panel 10 is made of thermal insulation material, and the outer panel 20 may be made of any suitable material such as wood, stone, composite, etc., and may be selected also to obtain the desired aesthetic properties on the outside of the building. It can be seen that when the outer panel 20 abuts the upper surface of the protrusions 12 of the insulation panel 10, air channels 13 are formed between the second surface 10*o* insulation panel 10 and an inner surface 20*i* of the outer panel 20. Fastening devices 40 (not shown in FIG. 1) are used to connect the outer panel 20 and the insulation panel 10 to the wall of the building.

Figure 2:
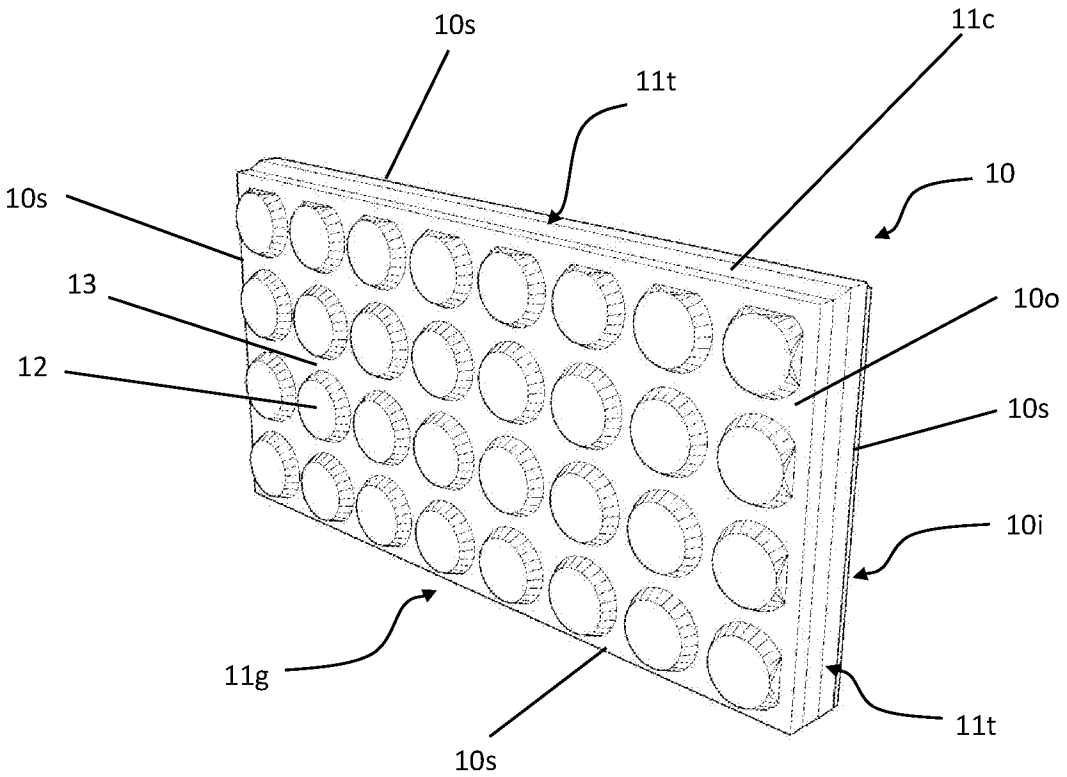
FIG. 2 is a perspective view of an insulation panel comprising rounded protrusions on a second surface, and tongue and groove profiles on the side surfaces.

FIG. 2 is a perspective view of an embodiment of an insulation panel 10 comprising rounded protrusions 12 on the second surface 10*o* (which is intended to be an outer surface of the insulation panel 10 relative to the building wall), and tongue and groove profiles 11*t*, 11*g*, on the side surfaces 10*s*. The insulation panel is made of thermal insulation material such as, but not limited to, mineral wool, such as glass wool, stone wool or slag wool, or polystyrene (foam board, typically MEPS), PUR (polyurethane), or PIR (polyisocyanurate). The insulation panel 10 may be a pressure-resistant insulation panel which is self-supporting. By pressure-resistant, it is meant that the insulation panel 10 will not be compressed when mounted as part of a façade insulating system 30 on a wall of the building, i.e. it will retain its shape.

In general, at least one side surface 10*s* of the insulation panel 10 is provided with a tongue profile 11*t* comprising a chamfered edge 11*c*, and at least one side surface 10*s* is provided with a groove profile 11*g* complementary to the tongue profile 11*t* for connecting adjacent insulation panels through a tongue and groove joint.

The insulation panel 10 may have a rectangular or square shape, wherein two side surfaces 10*s* are provided with a tongue profile 11*t*, and the two other side surfaces 10*s* are provided with a groove profile 11*g*. The tongue profile 11*t* may comprise a chamfered edge 11*c*, i.e. instead of a 90° corner, a section of the tongue profile 11*t* is inclined towards the first (inner) surface 10*i*. The tongue and groove profiles 11*t*, 11*g*, allows for sideways and upwards/downwards connection to adjacent insulation panels 10 by a tongue and groove joint, thus forming an overlap of insulation material.

Figure 14:
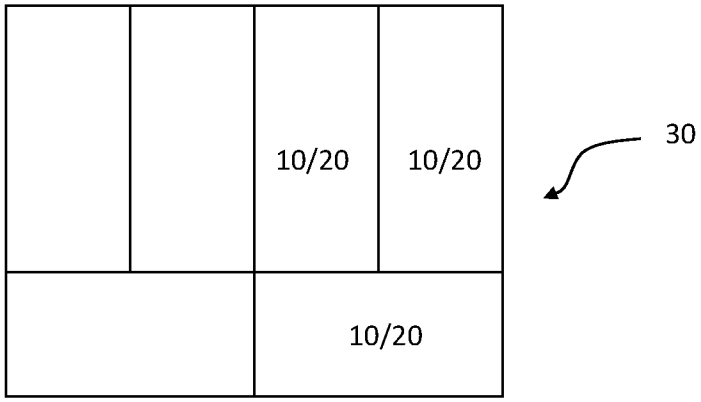
FIG. 14 is a schematic illustration of how the insulation panels and/or the outer panels may be arranged in a combination of lying and standing panels.

Two opposite side surfaces 10*s* of a corner of a rectangular or square shaped insulation panel 10 may comprise a tongue profile 11*t* and the two other side surfaces may comprise a groove profile 11*g*. For a rectangular insulation panel 10, this means that one long side surface 10*s* and one short side surface 10*s* will be provided with a tongue profile 11*t*, and one long side surface 10*s* and one short side surface 10*s* will be provided with a groove profile 11*g*. Thus, the insulation panel can be rotated 90°, i.e. it can be turned from lying to standing position, while still being connectable to the adjacent insulation panels 10 by the tongue and groove joint. This means that various arrangements of insulation panels 10 are possible. For example, one rectangular lying insulation panel 10 (where the short sides 10*s* represents the vertical sides of the insulation panel 10), may be connected to two rectangular standing insulation panels 10 (where the long sides 10*s* represents the vertical sides of the insulation panel 10). Such an arrangement is illustrated schematically in FIG. 14, which represents a schematical arrangement of insulation panels 10 and/or outer panels 20. This can be advantageous for example where a window or other structures are to be incorporated as part of the wall, or to achieve certain aesthetic properties. If the outer panels 20 are of the same shape and size as the insulation panels 10, a similar pattern will be obtained for the outer panels 20.

The protrusions 12 are distributed over the second surface 10*o* of the insulation panel 10 such that at least one air channel 13 extends between two opposite side surfaces 10*s* of the insulation panel 10. As illustrated in FIG. 2, the protrusions may be aligned in rows, one row above the other. The protrusions 12 may thus be aligned sideways (horizontally) and upwards/downwards (vertically) to create straight, unobstructed air channels 13 between the vertical and horizontal rows of protrusions 12. When the protrusions 12 are aligned in horizontal and vertical rows, as in FIG. 2, vertical and horizontal and air channels 13', 13" crosses each other over the second surface 10*o* of the insulation panel 10, as illustrated by the dashed lines in FIG. 3. Air can also flow in a non-straight path between the protrusions 12. Since the air typically flows from the bottom of the wall up to the roof end of the wall, it is beneficial to align the protrusions 12 such that straight, unobstructed air channels 13 are formed from bottom to top across the second surface 10*o* of the insulation panel 10.

The protrusions 12 may have a cylindrical shape or the shape of a truncated cone (as in FIG. 2). With a rounded shape of the protrusions 12, sharp corners or 90° edges can be avoided. Even more so in the case of a truncated cone, where also the edge formed between the bottom of the protrusion 12 and the second surface 10*o* of the insulation panel 10 will not form a sharp, 90° edge. The rounded shape reduces tension peaks under mechanical load. In aspects, the upper surface of the protrusions may be chamfered. When the protrusions 12 have the shape of a truncated cone, each protrusion 12 has a larger diameter closer to the second surface 10*o* of the insulation panel 10 than at the top surface of the protrusion 12, which abuts the outer panel 20. The air channels 13 formed between the protrusions 12 is thus wider in the area closer to the outer panel 20 than in the area closer to the second surface 10*o* of the insulation panel 10.

Figure 3:
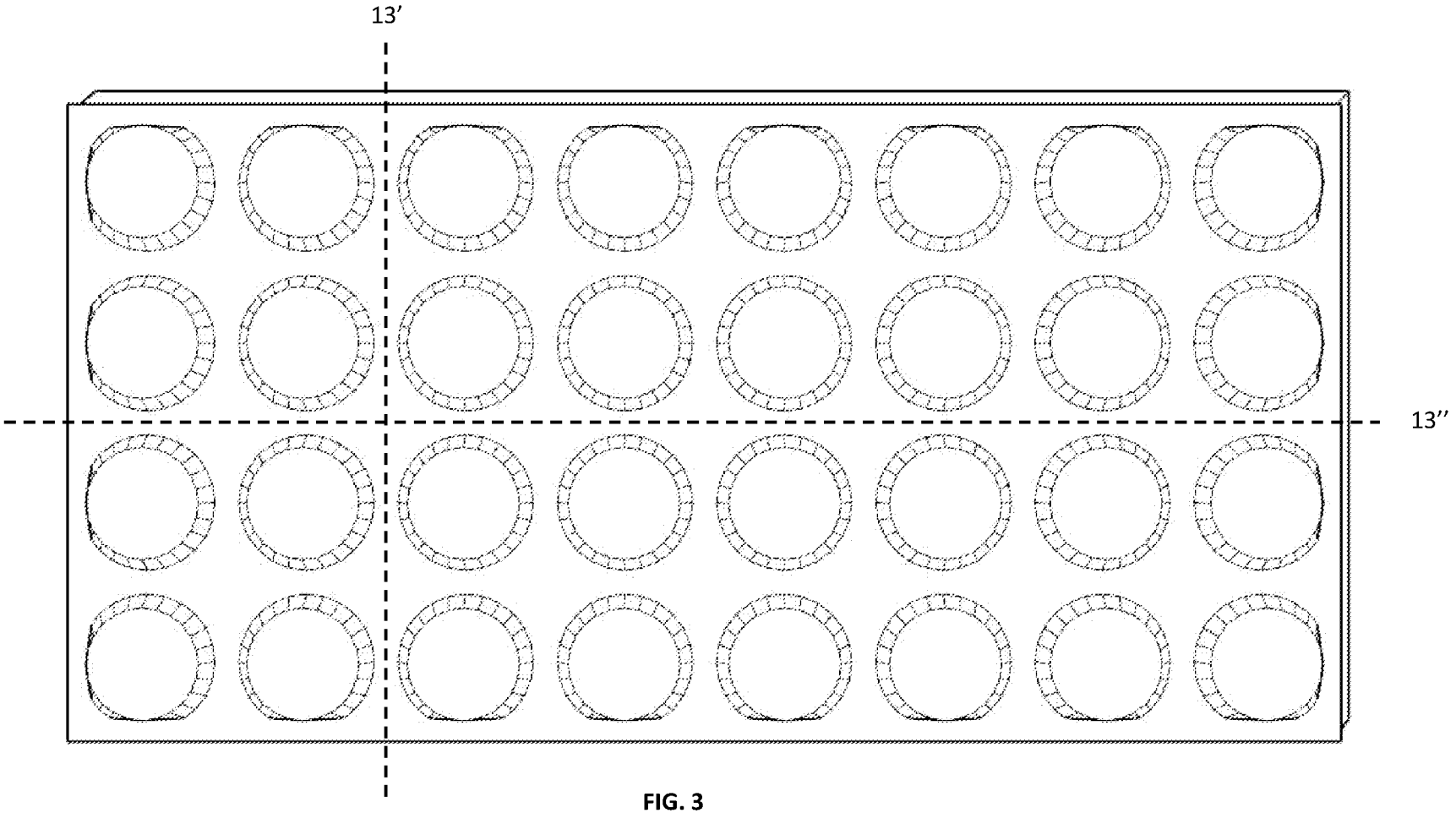
FIG. 3 is a front view of an insulation panel comprising rounded protrusions on a second surface, wherein vertical and horizontal air channels are illustrated by dashed lines.

When the protrusions 12 have a rounded shape and are aligned in rows in two perpendicular directions (e.g. horizontally and vertically, such as in FIG. 2), the air channels 13 formed between them will vary in shape and size across the length of the insulation panel 10, however, the air channel will follow a straight path from one side surface 10*s* to the opposite side surface 10*s*, as illustrated in FIG. 3.

The protrusions may be solid protrusions made of thermal insulation material. The protrusions 12 thus contribute to thermal insulation as well as to forming the air channels 13. The protrusions 12 may be formed integral with the insulation panel 10, i.e. the insulation panel 10 with the protrusions 12 may be made from one piece of raw material.

As an example, tests were performed using protrusions 12 having a bottom diameter of 113 mm, a top diameter of 93 mm, a height of 20 mm, and wherein the distance between the protrusions is 20 mm at the second surface 10*o*. This gave good results considering insulating properties and air flow for transferring away moisture. However, other variant protrusion designs may be envisaged, for example cylindrical shaped protrusions with a similar diameter. It can also be envisaged that if the protrusions are made smaller in diameter, the height can be reduced, and vice versa.

Figure 4:
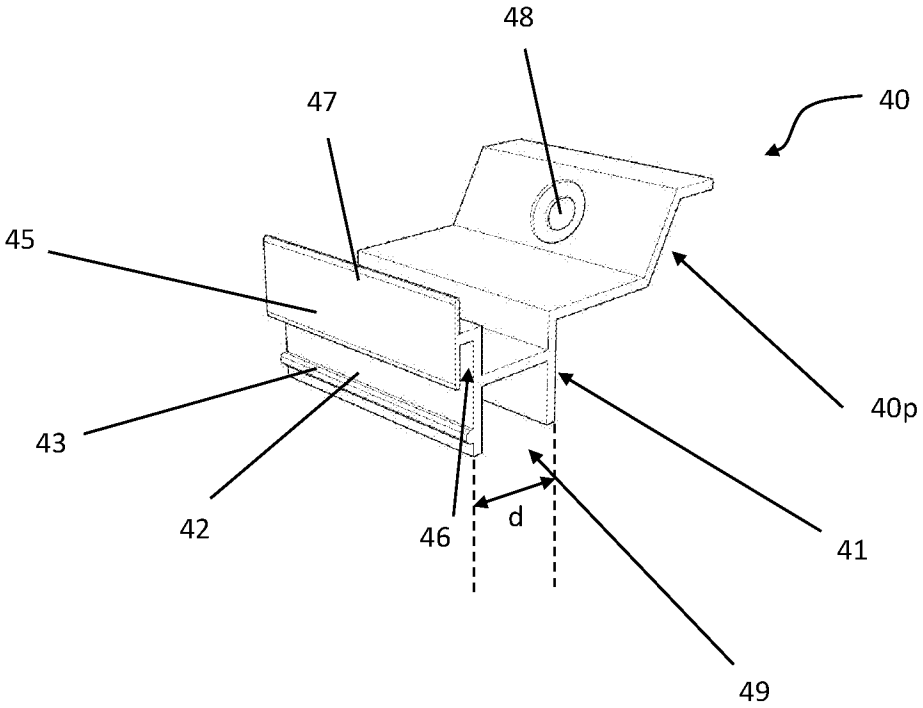
FIG. 4 is a perspective view of a fastening device according to an embodiment of the disclosure.
Figure 5:
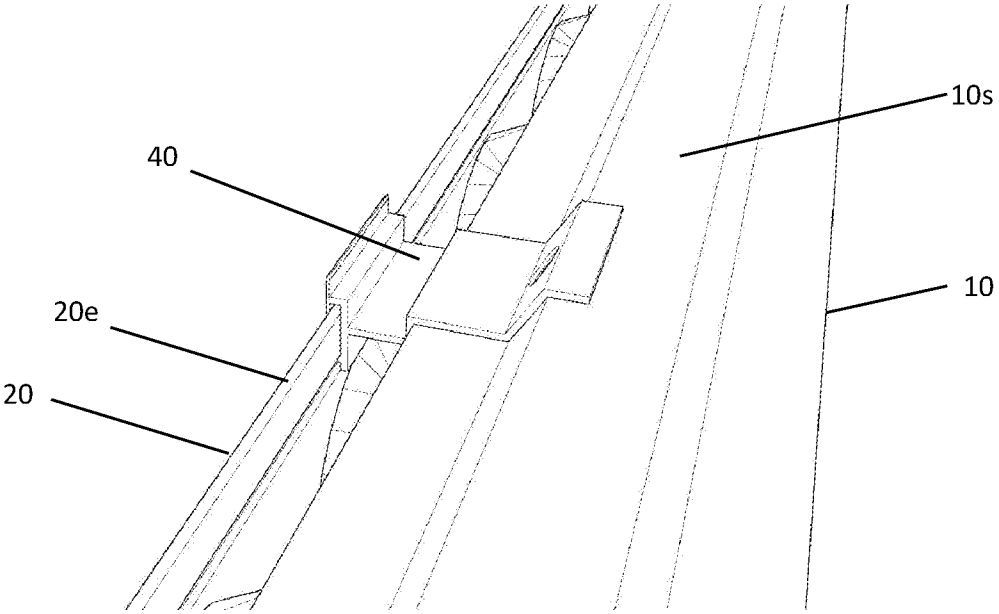
FIG. 5 is a detail perspective view of a fastening device according to FIG. 4, connected to an outer panel and an insulation panel.

FIG. 4 is a perspective view of a fastening device 40 and FIG. 5 is a perspective view of the fastening device 40 of FIG. 4 arranged on an outer panel 20 and an insulation panel 10. Various designs of the fastening device 40 for connecting the outer panel 20 and the insulation panel 10 to the wall of the building can be envisaged, and FIG. 4 discloses a design of a fastening device 40 which allows easy and fast connection and which does not require any modification to the outer panel 20, such as making holes for screws, or inserting a nail through the panel etc. In fact, a fastening device 40 as shown in FIG. 4 will not be visible from an outside of the façade insulating system 30 after it has been mounted on the building.

Fastening of the outer panel 20 and the insulation panel 10 to the building requires a plurality of fastening devices 40 arranged at various sides of the outer panel 20 and insulation panel 10.

Referring to FIG. 4, the fastening device 40 comprises a profile part 40*p* complementary shaped relative to the chamfered edge 10*c* of the tongue profile 11*t* of the insulation panel 10. A fastening element 48, such as, but not limited to a through hole, is provided on the profile part 40*p*. The profile part 40*p* will then, as shown in FIG. 5, follow the tongue profile 11*t* of the insulation panel, at least in the area of the chamfered edge 11*c*. If the fastening element 48 of the fastening device is a through hole; then a nail or a screw or the like, may be inserted through the hole and further into an anchor point of the building, such as a vertical post of the building framework. The fixation of the insulation panel 10 will thus have improved mechanical support due to vertical and horizontal force components.

The fastening device 40 may be configured to extend from the outer panel 20 and to finish short relative to the first surface 10*i* of the insulation panel 10, such that it does not come into contact with the wall of the building, ref. FIG. 5. Heat flow is thus not transferred to the building via the fastening device 40.

The fastening device 40 may comprise a distancing section 49. The distancing section 49 determines the distance "d" between the inner surface 20*i* of the outer panel 20 (the surface of the outer panel 20 which is facing the insulation panel 10), and the second surface 10*o* of the insulation panel 10 (from where the protrusions protrude 12), see for example FIG. 11. The distancing section 49 provides a distance "d" which is equal to the height of the protrusions 12. Thus, the protrusions 12 will abut against the outer panel 20. For the fastening device in FIG. 4, the distancing section 49 comprises two bracket sections, wherein one of the bracket sections defines a first contact surface 41 for abutment against the second surface 10*o* of the insulation panel 10, and wherein the other bracket section defines a second contact surface 42 for abutment against the inner surface 20*i* of the outer panel 20. The fastening device 40 may comprise a rim 43 arranged on the second contact surface 42. The rim 43 may be configured to engage with a slot 23 in the inner surface 20*i* of the outer panel 20, see FIG. 6*c* and FIG. 7. This provides support and mechanical stability to the façade insulating system 30 and will ensure correct positioning of the outer panel 20 during assembly and contribute to make assembly easier. Further details of the fastening device 40 will be described after describing features of the outer panel 20.

Figure 6C:
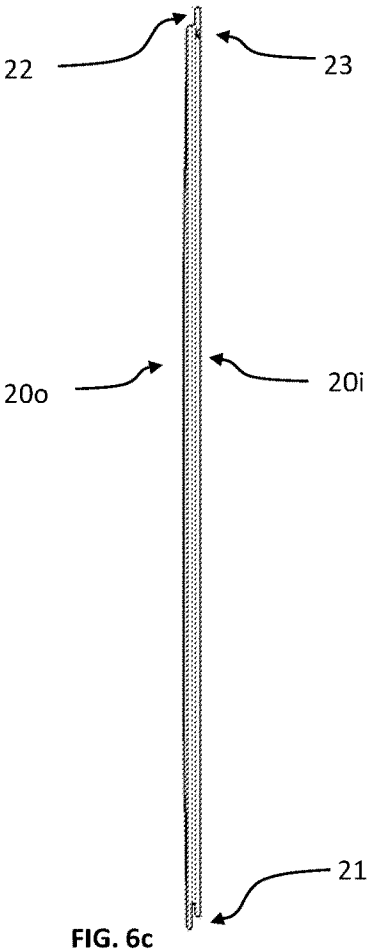
FIGS. 6*a*, 6*b* and 6*c* is a perspective front view, a top view, and a side view of an embodiment of an outer panel, respectively.
Figure 6B:
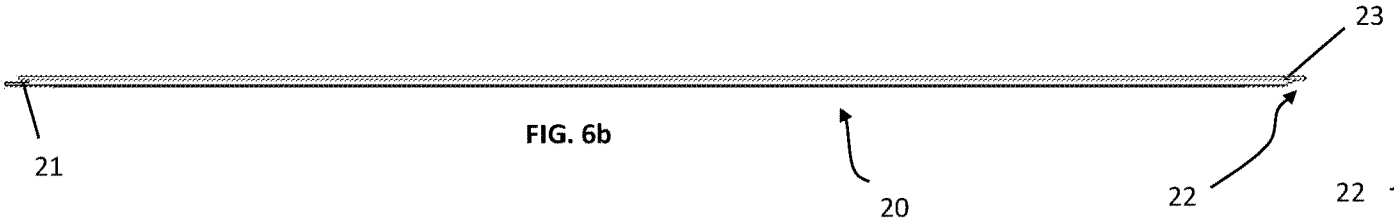
Figure 6A:
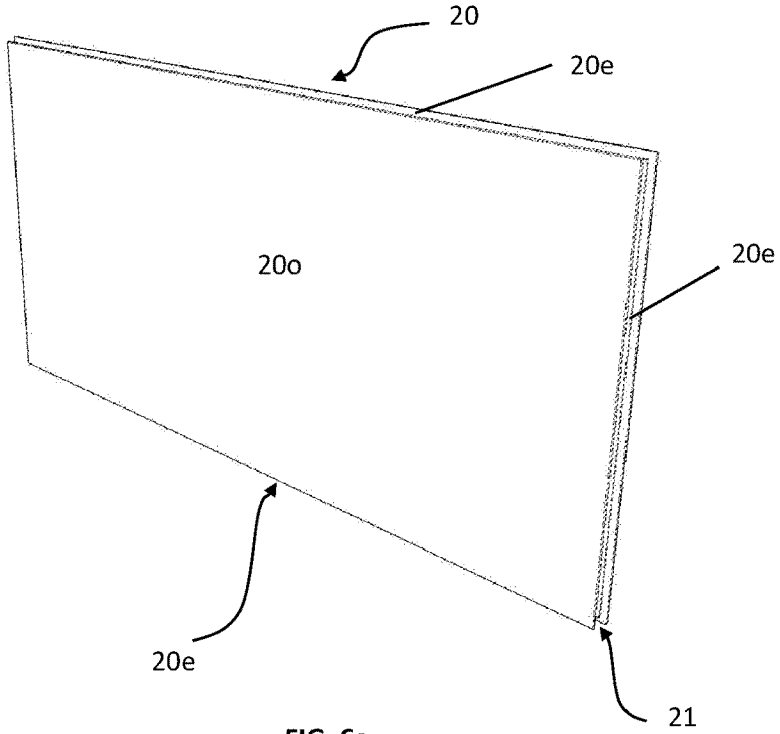

FIGS. 6*a*, 6*b* and 6*c* show a perspective front view, a top view, and a side view of an outer panel 20, respectively.

The outer panel 20 comprises an inner surface 20*i* that faces the insulation panel 10, and an outer surface 20*o*, which will be the outermost surface of the building. Thus, material selection, surface finish, geometric shape, and arrangement of the outer panels 20 will play a significant role in the architectural and/or aesthetic expression of the building. The side edges 20*e* of the outer panel may comprise a recess 21, 22 for engaging with the fastening devices 40.

The outer panel 20 may have a rectangular or square shape. It may have the same shape and size as the insulation panel 10. The outer panel 20 may also have a different size than the insulation panel 10, however it is preferably configured such that the edges 20*e* of the outer panel 20 can be located adjacent the side surfaces 10*s* of one or more insulation panels 10. This can be obtained if the outer panel 20 covers an integer number of insulation panels 10. For example, one outer panel 20 may cover two complete insulation panels 10 or vice versa. One outer panel 20 can for example also cover four insulation panels 10, such as two side-by-side insulation panels 10 stacked on top of two other side-by side insulation panels 10. Other configurations may also be envisaged.

In FIG. 6*c* it can be seen that the outer panel 20 comprises a recess 22 at the top edge 20*e* and a recess 21 at the bottom edge 20*e*. The two other side edges 20*e* may also comprise recesses 21, 22 (ref. FIG. 6*b*), such that all four edges 20*e* may be connected to the fastening device 40.

Referring now to FIG. 4, it can be seen that the fastening device 40 may comprise a bracket piece 45 which is configured for engaging with the recesses 21, 22 in the side edges 20*e* of the outer panel 20. The upper tongue part 47 of the bracket piece can engage the recess 21 by being inserted into the recess. The opposite end of the bracket piece 45 also has a tongue part and a recess 46 between the bracket piece 45 and the second contact surface 42, which can engage the recess 22 of the outer panel 20. This connection can be seen in FIG. 8. This allows for the fastening device 40 to connect the outer panels 20 to the wall of the building, and also allows for a smooth façade surface as the fastening devices 40 are not extending outside the outer panels 20 and can be invisible when seeing the façade from the outside.

The outer panel 20 may be attached to the insulation panel 10 by an adhesive. The adhesive may be applied prior to transport such that the insulation panel 10 and outer panel 20 will be handled and transported as one unit, thereby reducing risk of damage to the outer panel 20 as the insulation panel 10 will provide support. The adhesive may also be applied before mounting onto the building structure in order to facilitate the assembly and mounting process as handling and positioning will be easier.

Figure 7:
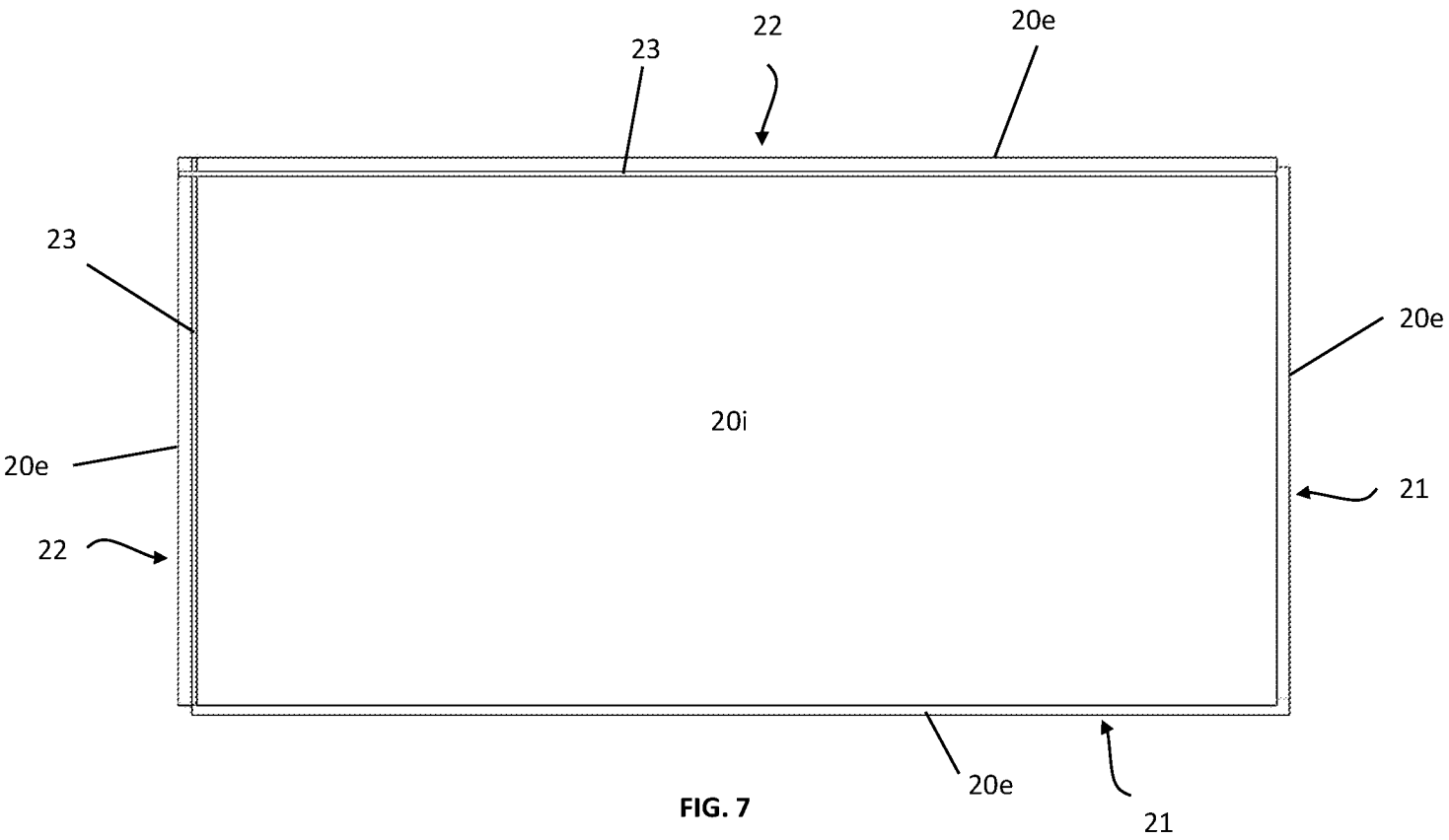
FIG. 7 is a front view of an inner surface of an embodiment of an outer panel.

FIG. 7 is a front view of an inner surface 20*i* of an outer panel 20. Slots 23 may be provided proximate the side edges 20*e*. The slots 23 are configured for engaging with the rim 43 of the fastening device 40.

The recess 21 of the lower side edge 20*e* of FIG. 7 and/or one of the other side edges 20*e* of the outer panel 20 may have a U-shape, i.e. giving support to the tongue part 47 in two opposite directions, as shown in FIG. 6*c*. The recess 22 of the upper side edge 20*e* of FIG. 7 and/or one of the other side edges 20*e* may be open (see FIG. 6*c*), such that it gives support only on one side to the bracket piece 45, thus the recess 46 on the fastening device 40 and the slot 23 engaging with the rim 43 provides additional support for this connection (see also FIG. 8). This connection allows for easy installation of the façade insulation system 30 while providing good support to the outer panels 20. This connection can be seen in FIG. 8. The U-shaped recess 21 may, at the side of the outer surface 20*o*, extend so as to cover the bracket piece 45 of the fastening device 40, thus the fastening device 40 will be invisible when seeing the façade insulating system form the outside.

Similar as for the insulation panel 10, two opposite side edges 20*e* of a corner of a rectangular or square shaped outer panel 20 may comprise a U-shaped recess 21 and the two other side edges 20*e* may comprise an open recess 22. For a rectangular outer panel 20, this means that one long side edge 20*e* and one short side edge 20*e* will be provided with a U-shaped recess 21, and one long side edge 20*e* and one short side edge 20*e* will be provided with an open recess 21, as shown for example in FIG. 6*a*. Furthermore, one short side and one long side of the outer panel 20 may be provided with a slot 23. The slots 23 are arranged proximate the side edges 20*e* that comprises a recess 22, since this recess is open on one side.

Thus, the outer panel 20 can be rotated 90°, i.e. it can be turned from lying to standing position, while still being connectable to the adjacent outer panels 20 by fastening device 40. This means that various arrangements of outer panels 20 are possible. For example, one rectangular lying outer panel 20 (where the short edges 20*e* represents the vertical height of the outer panel 20), may be connected to two rectangular standing outer panels 20 (where the long sides 20*e* represents the vertical height of the outer panel 20). Such an arrangement is illustrated schematically in FIG. 14, which represents a schematical arrangement of insulation panels 10 and/or outer panels 20. This can be advantageous for example where a window or other structures are to be incorporated as part of the wall, or to achieve certain aesthetic properties.

Figure 8:
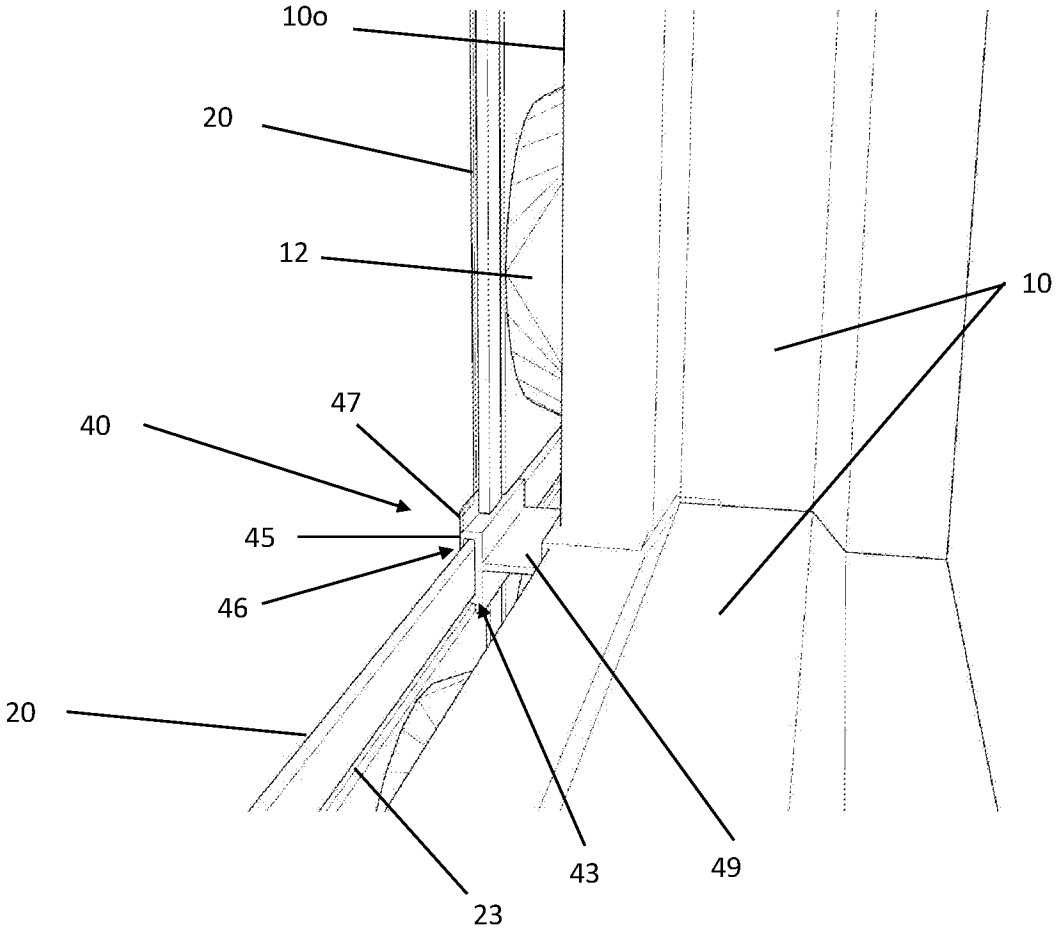
FIG. 8 is a perspective view of the connection between adjacent insulation panels and outer panels with a fastening device.

FIG. 8 is a perspective view of the connection between adjacent insulation panels and outer panels 20 with a fastening device 40. The figure shows the tongue and groove connection between the insulation panels 10, the distancing section 49 of the fastening device 40 which allows for a space between the outer panel 20 and the second surface 10*o* of the insulation panel 10 which is equal to the height of the protrusions 12. It also shows that the rim 43 of the fastening device 40 engages the slot 23 of the outer panel 20. The upper tongue part 47 of the bracket piece 45 is inserted into the U-shaped recess 21 (see FIG. 6*c*) on the bottom side edge 20*e* of an outer panel 20, while the recess 22 (see FIG. 6*c*) of the upper side edge 20*e* of the outer panels 20 arranged below fits into the recess 46 of the fastening device 40.

Figure 9:
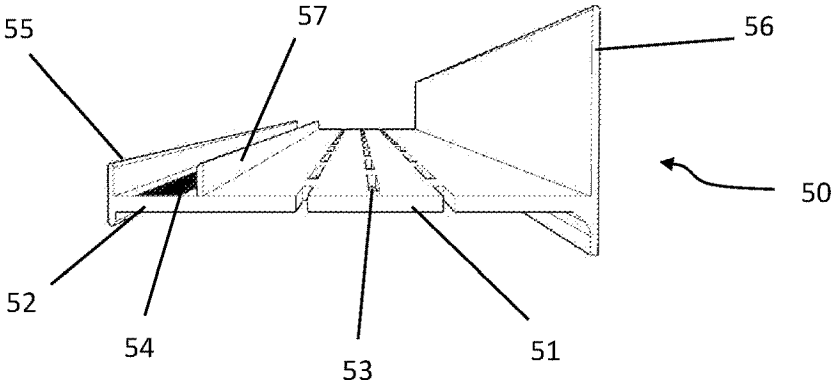
FIG. 9 is a perspective side view of a base profile for use on a lower most row of insulation panels and outer panels of the façade.
Figure 10:
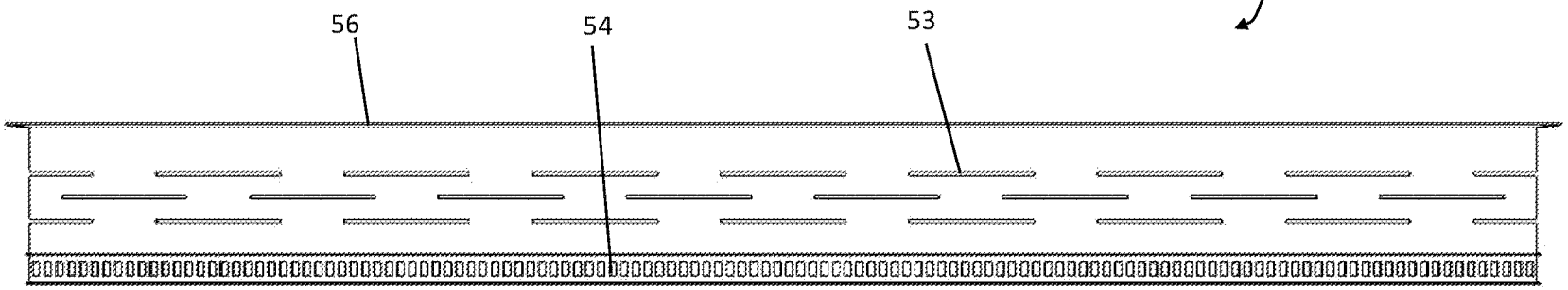
FIG. 10 is a top view of the base profile in FIG. 9.

FIG. 9 is a perspective side view of a base profile 50 for use on a lower most row of insulation panels 10 and outer panels 20 of the façade, and FIG. 10 is a top view of the base profile 50. The base profile 50 is configured to connect to the bottom side surface 10*s* (see for example FIG. 2) of one or more adjacent insulation panels and to the bottom side edge 20*e* of one or more adjacent outer panels 20 (see for example FIG. 6*a*). The base profile 50 comprises a base profile bracket piece 55 configured for engaging with a recess 21 in the edge 20*e* of the one or more outer panels 20 (see FIG. 6*c*). This base profile bracket piece 55 may comprise a similar design to the bracket piece 45 of the fastening device 40.

The base profile 50 may comprise a first section 51 for receiving the side surface 10*s* of the one or more insulation panels 10 (see FIG. 11), and a second section 52 arranged between the first section 51 and the base profile bracket piece 55. The base profile 50 may comprise a first wall section 56 arranged at back end (towards the building wall) and a second wall section 57 arranged at a distance from the first wall section 56 corresponding to the distance between the first and second (i.e. inner and outer) surfaces 10*i*, 10*o* of the insulation panel 10 (see for example FIG. 1). The base profile 50 may be fastened to the framework of the building by screws, nails, glue, or any other suitable fastening means at its back end (near the first section).

The first section 51 comprises thermal break slots 53 which are arranged to prevent heat flow across the base profile 50. The thermal break slots 53 are preferably arranged as longitudinal slots over the length of the first section 51. Preferably, several rows of longitudinal thermal break slots 53 are arranged next to each other, and where the slots of one row are longitudinally displaced relative to the neighboring row of slots, as is shown in FIG. 10. The heat flow path across the base profile 50, especially in the transverse direction, is thus obstructed by the thermal break slots 53.

The second section 52 comprises vent gaps 54 which are configured to allow air to flow in through the gaps 54. The vent gaps 54 are preferably arranged transversally over the width of the second section 52 of the base profile 50. Since the second section 52 with the vent gaps 54 is arranged below the area of protrusions 12 and air channels 13 (see FIG. 11), the vent gaps are entrance points for air to enter and flow up through the air channels 13. This is more easily seen in FIG. 11.

Figure 11:
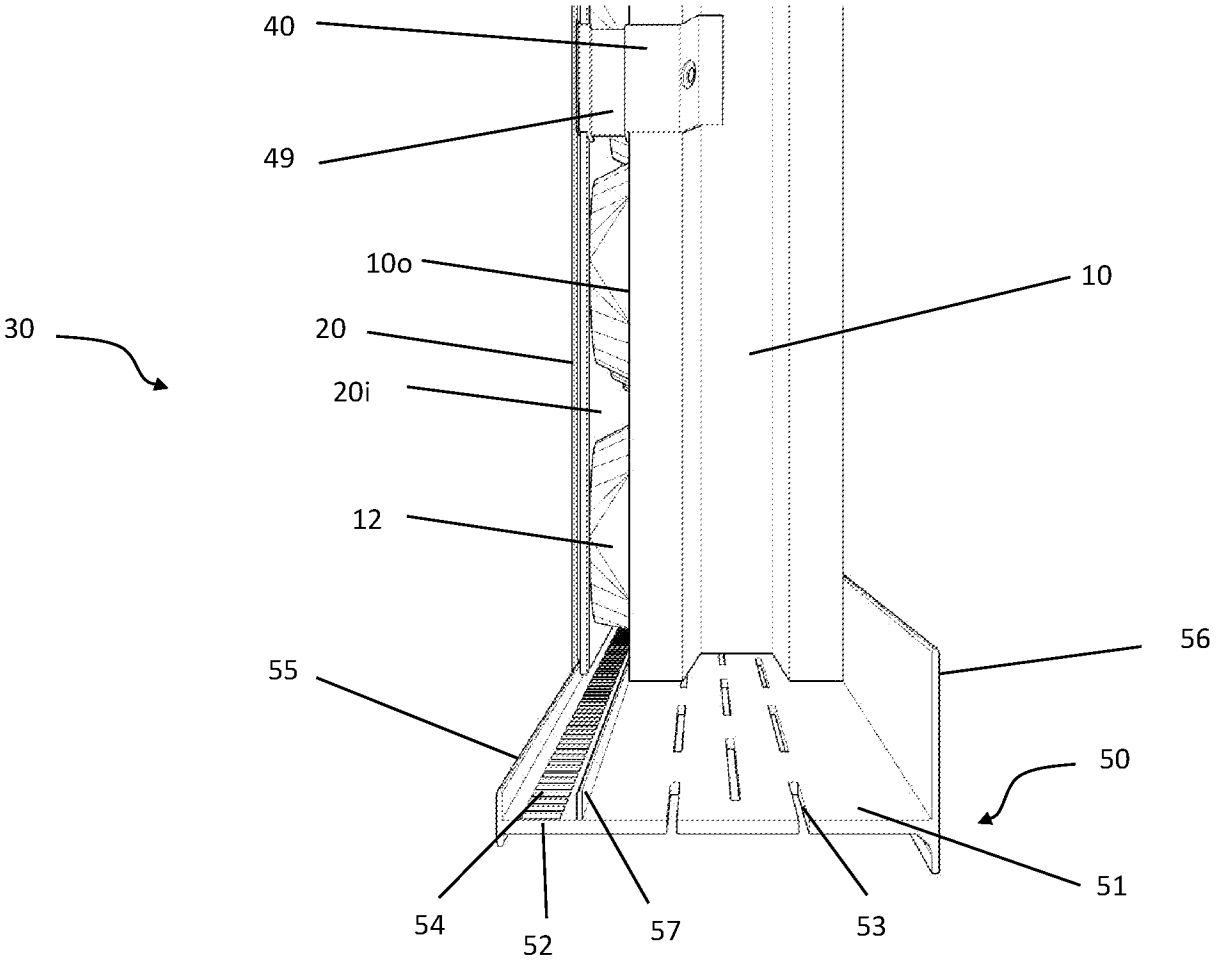
FIG. 11 is a perspective side view of an outer panel and an insulation panel connected by fastening devices (only one is shown) and connected to a base profile.

FIG. 11 is a perspective side view of an outer panel 20 and an insulation panel 10 connected by fastening devices 40 (only one is shown) and connected to a base profile 50 at the bottom. This illustrates the connection between the various components of the façade insulating system 30 at the lower most row. Fastening devices 40 are arranged on both vertical side surfaces 10*s* and the top side surface 10*s* of the insulation panel 10. The fastening device 40 shown in FIG. 11 is connected to a side surface 10*s* of the insulation panel 10 comprising a tongue profile 11*t*, while the bottom side surface 10*s* (facing the base profile 50) comprises a groove profile 11*g*.

Figure 12:
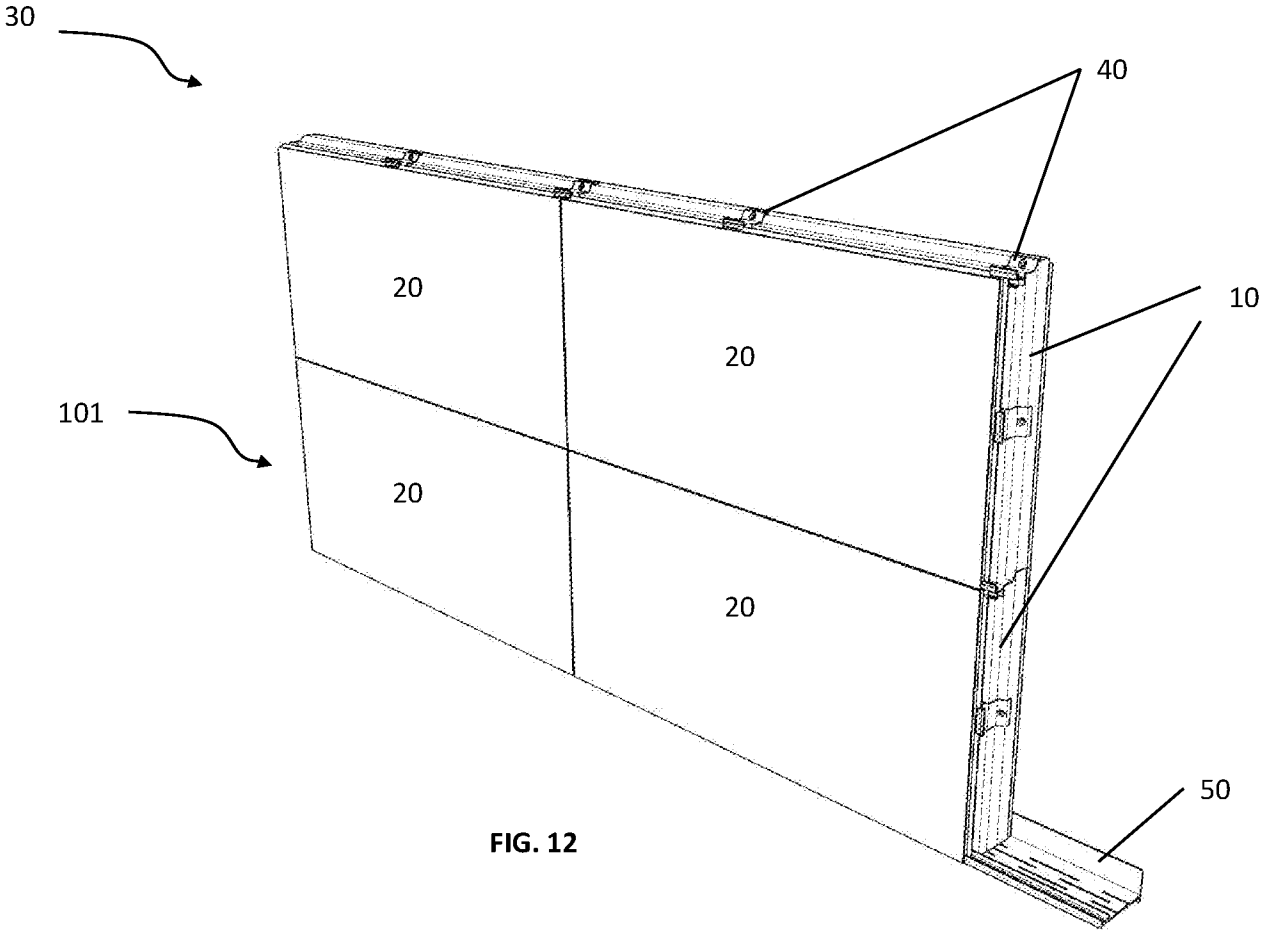
FIG. 12 shows the façade insulating system where a number of insulation panels and outer panels (here, four of each) are arranged in rows, one row arranged above the other, the insulation panels being connected end-to-end vertically and horizontally through the tongue and groove joint, and the outer panels being connected to the insulation panels by the fastening devices, and connected to a base profile at the bottom.

FIG. 12 shows the façade insulating system 30 where a number of insulation panels 10 and outer panels 20 (here, four of each) are arranged in rows, one row arranged above the other, the insulation panels 10 being connected end-to-end vertically and horizontally through the tongue and groove joint, and the outer panels being connected to the insulation panels 10 by the fastening devices 40, and connected to a base profile 50 at the bottom. During assembly of the façade, more insulation panels 10 and outer panels 20 will be connected sideways and upwards. Several base profiles 50 will also be connected sideways, depending on the length of each base profile and of the wall of the building. In FIG. 12, the insulation panels and the outer panels 20 are of the same size and shape. It may also be envisaged that their size may be different, so long as the side surfaces 10*s* of the insulation panel 10 can be arranged next to the outer edge 20*e* of an insulation panel 20 for connection using the fastening device 40 (as shown in FIG. 5 for example). The outer panel 20 may for example have length and/or a height which is twice the length/height of the insulation panel 10.

Figure 13:
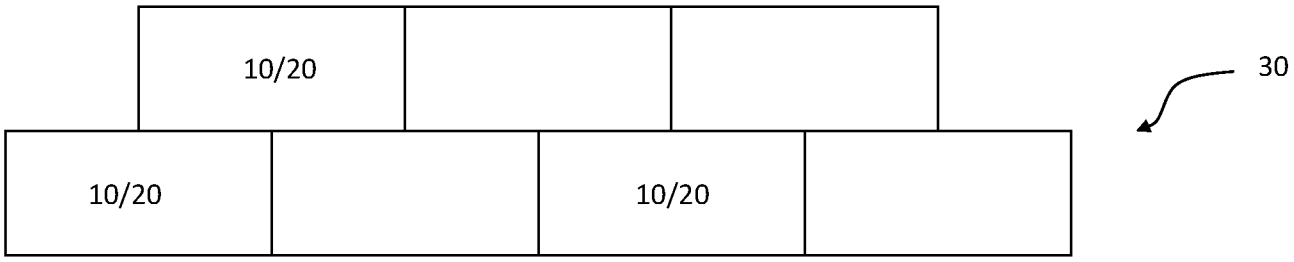
FIG. 13 is a schematic illustration of how the insulation panels and/or the outer panels 20 may be arranged in a brick pattern.

The insulation panels 10 and outer panels 20 may be arranged in various patterns. For example, one row of insulation panels 10 and outer panels 20 may be displaced sideways to obtain a brick pattern, ref. FIG. 13, where the rectangles represent either the insulation panel 10 or the outer panel 20, or both. As previously mentioned, various combinations of lying and standing insulation panels 10 can also be envisaged, as in FIG. 14, where the rectangles represent either the insulation panel 10 or the outer panel 20, or both.

In one aspect, the mounting process may comprise arranging and fastening one or more base profiles 50 to the framework of a building. A first row of insulation panels 10 may be arranged on the base profile 50, connected sideways by the tongue and groove joint, as shown for example in FIG. 12. Then an outer panel 20 can be placed with the U-shaped recess 21 on the base profile bracket piece 55, in front of the insulation panels 10, as shown for example in FIG. 11. At the vertical sides and top side of the outer panel 20 and the insulation panel 10 arranged behind, fastening devices 40 can be arranged using the bracket piece 45 and the recesses 21, 22 and slot 23 on the outer panel 20. A screw can be inserted through the fastening element 48 of the fastening device 40 and fastened to the framework of the building. Then, the next sideways outer panels 20 can be arranged on the base profile 50 until the lower most row 101 of insulation panels 10 and outer panels are arranged, as shown in FIG. 12. Now, the next rows of insulation panels 10 and outer panels 20 may be arranged in a similar manner, using the tongue and groove connection between the insulation panels 10 both in upwards/downwards direction and in sideways direction, and using fastening devices 40 on all sides of the outer panels 20. Thus, screws, nails or the like are only needed to fix the fastening devices to the building wall, while the outer panels 20 are only connected to the wall by engagement with the bracket piece 45 of the fastening device 40.

In the preceding description, various aspects of the independent claims have been described. For purposes of explanation, specific numbers, systems and configurations were set forth in order to provide a thorough understanding of the system and its workings. However, this description is not intended to be construed in a limiting sense. Various modifications and variations of the illustrative embodiment, as well as other embodiments of the system, which are apparent to persons skilled in the art to which the disclosed subject matter pertains, are deemed to lie within the scope of the present invention as defined in the attached claims.

| REFERENCE NUMBERS IN FIGURES | |
|---|---|
| 10 | insulation panel |
| 10i | first surface of insulation panel |
| 10o | second surface of insulation panel |
| 10s | side surface of insulation panel |
| 11t | tongue profile |
| 11g | groove profile |
| 11c | chamfered edge |
| 12 | protrusion |
| 13 | air channel |
| 14 | groove profile |
| 20 | outer panel |
| 20e | side edge of outer panel |
| 20i | inner surface of outer panel |
| 20o | outer surface of outer panel |
| 21 | recess |
| 22 | recess |
| 23 | Slot in inner surface of outer panel |
| 30 | façade insulating system |
| 40 | fastening device |
| 40p | profile part of fastening device |
| 41 | first contact surface for abutment against the second surface 10o of the insulation panel 10 |
| 42 | second contact surface for abutment against the inner surface 20i of the outer panel 20. |
| 43 | rim |
| 45 | bracket piece of fastening device |
| 46 | recess of bracket piece 45 |
| 47 | upper tongue part of bracket piece 45 |
| 48 | fastening element of fastening device |
| 49 | distancing section |

-continued

| REFERENCE NUMBERS IN FIGURES | |
|---|---|
| 50 | base profile |
| 51 | first section of base profile |
| 52 | second section of base profile |
| 53 | thermal break slot |
| 54 | vent gap |
| 55 | base profile bracket piece |
| 56 | first wall section of base profile |
| 57 | second wall section of base profile |
| 101 | Lower most row |

The invention claimed is:

1. A façade insulating system comprising:

an insulation panel of thermal insulation material comprising a first surface configured to face a wall of a building, a second surface opposite the first surface, and side surfaces;

an outer panel;

a plurality of fastening devices configured to connect the outer panel and the insulation panel to the wall of the building;

wherein the insulation panel comprises protrusions distributed over the second surface of the insulation panel, the protrusions being configured to abut the outer panel, such that, when the outer panel and the insulation panel are connected to the wall of the building, air channels are formed between the second surface of the insulation panel and the outer panel;

wherein each of the plurality of fastening devices comprises a distancing section, wherein the distancing section comprises two bracket sections, wherein a first bracket section of the two bracket sections defines a first contact surface that abuts against the second surface of the insulation panel, and wherein a second bracket section of the two bracket sections defines a second contact surface that abuts against an inner surface of the outer panel, thereby determining a distance equal to a height of the protrusions between the second surface of the insulation panel and the inner surface of the outer panel.

2. The façade insulating system according to claim 1, wherein the protrusions are distributed such that at least one air channel extends between two opposite side surfaces of the insulation panel.

3. The façade insulating system according to claim 1, wherein the protrusions are solid protrusions made of the thermal insulation material.

4. The façade insulating system according to claim 1, wherein the protrusions have a cylindrical shape or a truncated cone shape.

5. The façade insulating system according to claim 1, wherein a first side surface of the insulation panel is provided with a tongue profile comprising a chamfered edge, and wherein a second side surface of the insulation panel is provided with a groove profile complementary to the tongue profile for connecting adjacent insulation panels through a tongue and groove joint.

6. The façade insulating system according to claim 5, wherein each fastening device of the plurality of fastening devices comprises a profile part complementary shaped relative to the chamfered edge, and wherein a fastening element is provided on the profile part.

7. The façade insulating system according to claim 1, wherein each fastening device of the plurality of fastening devices is configured to extend from the outer panel and to finish short relative to the first surface of the insulation panel.

8. The façade insulating system according to claim 1, wherein each fastening device of the plurality of fastening devices comprises a bracket piece, and wherein two opposing side edges of two neighboring outer panels each comprise a recess, thereby forming two opposing recesses, and wherein the bracket piece is configured for engaging with the two opposing recesses.

9. The façade insulating system according to claim 1, wherein a first surface of the outer panel comprises a slot and each fastening device of the plurality of fastening devices comprises a rim, wherein the rim of each fastening device of the plurality of fastening devices is configured to engage with the slot.

10. The façade insulating system according to claim 1, wherein the outer panel is attached to the insulation panel by an adhesive.

11. The façade insulating system according to claim 1, comprising a base profile for connecting to a side surface of one or more adjacent insulation panels and for connecting to an edge of one or more adjacent outer panels, the base profile comprising a base profile bracket piece configured for engaging with a recess in the edge of the one or more adjacent outer panels.

12. The façade insulating system according to claim 11, wherein the base profile comprises a first section for receiving the side surface of the one or more adjacent insulation panels, and a second section arranged between the first section and the base profile bracket piece, wherein the first section comprises thermal break slots and/or wherein the second section comprises vent gaps.

13. The façade insulating system according to claim 5, comprising a number of insulation panels and outer panels arranged in rows, one row arranged above the other, the number of insulation panels being connected end-to-end vertically and horizontally through the tongue and groove joint, and the outer panels being connected to the number of insulation panels by the plurality of fastening devices.

14. The façade insulating system according to claim 13, comprising one or more base profiles connected to a lower most row of insulation panels and outer panels.

15. An insulation panel for a façade insulating system of a building, the insulation panel being made of a thermal insulation material and wherein the insulation panel comprises:

a first surface configured to face a wall of the building, a second surface opposite the first surface, the second surface being configured to face an outer panel, protrusions distributed over the second surface, the protrusions having a cylindrical shape or a truncated cone shape and being a solid body of thermal insulation material, wherein the protrusions are configured to abut the outer panel, such that air channels are formed between the second surface of the insulation panel and the outer panel when the protrusions abut against the outer panel, and wherein the insulation panel is configured to be connected to the wall of the building through a plurality of fastening devices, wherein each of the plurality of fastening devices comprises a distancing section, wherein the distancing section comprises two bracket sections, wherein a first bracket section of the two bracket sections defines a first contact surface that abuts against the second surface of the insulation panel;

wherein a second bracket section of the two bracket sections defines a second contact surface that abuts against an inner surface of the outer panel, thereby determining a distance equal to a height of the protrusions between the second surface of the insulation panel and the inner surface of the outer panel.

16. The façade insulating system according to claim 6, comprising a number of insulation panels and outer panels arranged in rows, one row arranged above the other, the number of insulation panels being connected end-to-end vertically and horizontally through the tongue and groove joint, and the outer panels being connected to the number of insulation panels by the plurality of fastening devices.

17. The façade insulating system according to claim 11, comprising a number of insulation panels and outer panels arranged in rows, one row arranged above the other, the number of insulation panels being connected end-to-end vertically and horizontally through a tongue and groove joint, and the outer panels being connected to the number of insulation panels by the plurality of fastening devices.

18. The façade insulating system according to claim 17, comprising one or more base profiles connected to a lower most row of insulation panels and outer panels.

19. The façade insulating system according to claim 12, comprising a number of insulation panels and outer panels arranged in rows, one row arranged above the other, the number of insulation panels being connected end-to-end vertically and horizontally through a tongue and groove joint, and the outer panels being connected to the number of insulation panels by the plurality of fastening devices.

20. The façade insulating system according to claim 19, comprising one or more base profiles connected to a lower most row of insulation panels and outer panels.

* * * * *